United States Patent [19]

Hicks et al.

[11] 3,997,948

[45] Dec. 21, 1976

[54] MODULAR PET BURIAL CASKET

[76] Inventors: Keith P. Hicks, 4121 Roberts Road, Fairfax, Va. 22030; Jacob H. Steinberg, 2631 E. West Highway, Chevy Chase, Md. 20015

[22] Filed: Oct. 30, 1975

[21] Appl. No.: 627,336

[52] U.S. Cl. ..... 27/2; 27/7; 220/8

[51] Int. Cl.[2] ..... A61G 17/00

[58] Field of Search ..... 27/2, 6, 7, 35; 220/8, 220/346

[56] References Cited

UNITED STATES PATENTS

| | | | |
|---|---|---|---|
| 561,241 | 6/1896 | Ripson | 27/2 |
| 565,566 | 8/1896 | Ramsey | 27/2 |
| 756,297 | 4/1904 | Tabor et al. | 27/2 |
| 989,482 | 4/1911 | Bond | 27/35 |
| 1,495,336 | 5/1924 | Loomis | 220/8 |
| 1,695,222 | 12/1928 | Arnold et al. | 220/8 X |
| 2,472,582 | 6/1949 | Green | 220/346 |

*Primary Examiner*—John D. Yasko

[57] ABSTRACT

This invention comprises a modular pet casket comprising one or more modular units which can be locked into position to provide a predetermined longitudinally extended casket for enclosing small, medium or large deceased pets.

11 Claims, 8 Drawing Figures

11
26
20
14
16
16a
12
22
15b
24
a
b
c
2
3

MODULAR PET BURIAL CASKET

In view of the fact that there are some 20,000,000 or more pets, whose life span is rather short compared to their owner's life span, a problem arises when a loved pet dies and must be suitably buried. At present, no provision has been made by the casket manufacturers, morticians or veterinarians to solve this problem. A burial of a loved pet in a "people" casket is far too prohibitive in cost for most pet owners.

It is therefore an object of this invention to provide an economical, lightweight casket for a deceased pet.

It is a further object to provide a modular casket that is longitudinally adjustable in accordance with the size of the deceased pet.

It is a further object to provide interlocking means which can be used to fixedly connect the needed modular units in accordance with the longitudinal length of the deceased pet.

It is a further object to provide for nestability for economical storage of the pet caskets.

It is a further object to provide a locking cover for the modular casket units.

It is a further object to use said cover as a primary locking means.

It is a further object to use said cover edges for lifting purposes.

Resins with embedded glass fiber have been used for making "person" caskets as evidenced by U.S. Pat. Nos. 2,848,479 and 3,159,901. However, these caskets are molded in such intricate design that they are just as expensive as are caskets made from such conventional materials as metal or wood.

Other objects and advantages of this invention will be apparent from the following description taken in conjunction with the accompanying drawings wherein.

Figures 1, 2, 3, 4, 5, 6, 7, 8:
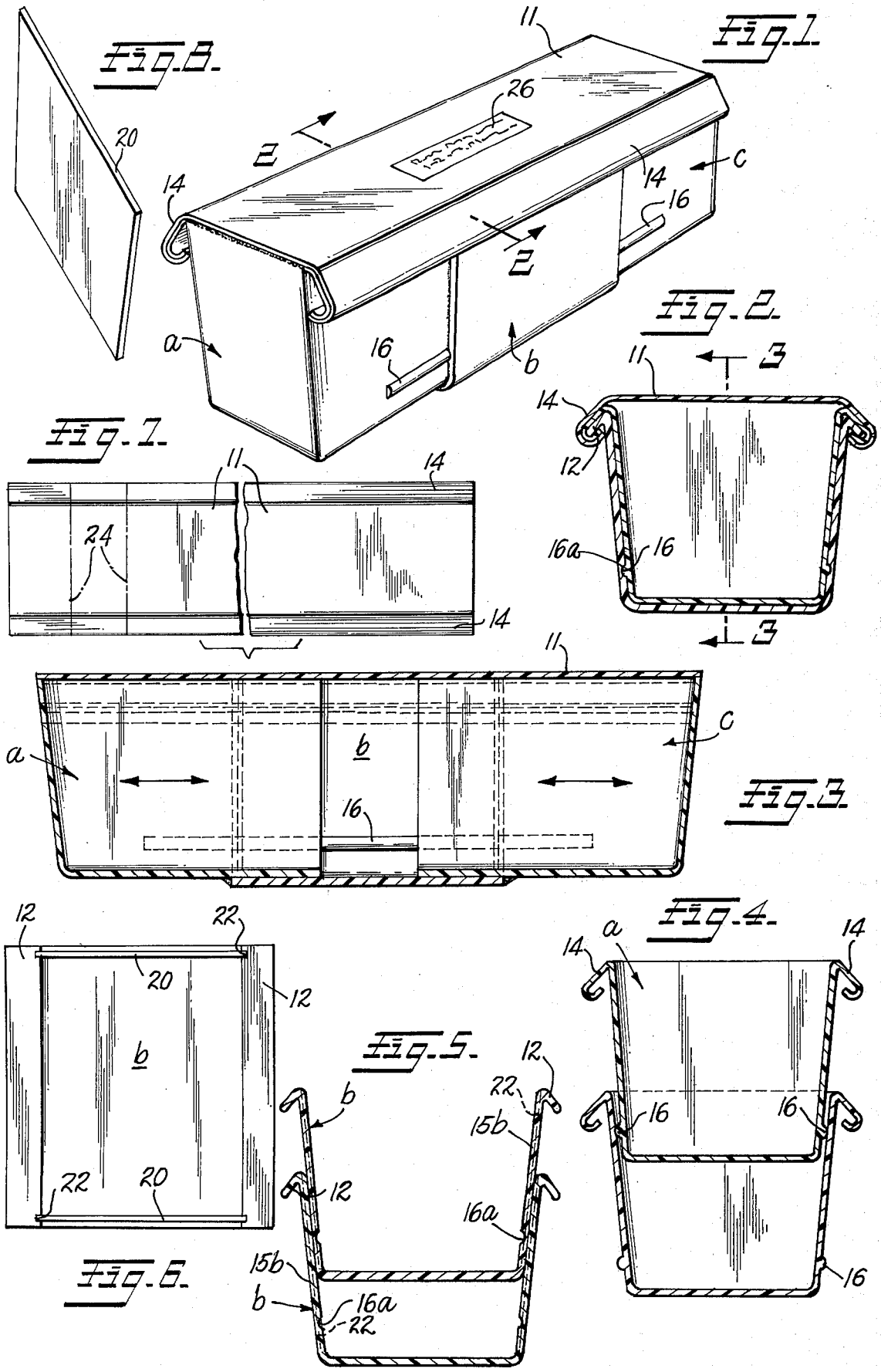
FIG. 1 is a perspective view of an adjustable modular animal casket according to the present invention.
FIG. 2 is an enlarged transverse sectional view, taken on the line 2—2 of FIG. 1.
FIG. 3 is a longitudinal vertical sectional view, taken on the line 3—3 of FIG. 2.
FIG. 4 is a transverse vertical sectional view showing a pair of modular end sections of the pet casket in a nested position.
FIG. 5 is a transverse vertical sectional view, similar to FIG. 4 but showing a pair of middle modular sections for the pet casket in a nested position.
FIG. 6 is a plan view of a middle modular section of the pet casket, without the cover showing end plates in position to form a suitable length of the casket to accommodate a small animal.
FIG. 7 is a fragmentary plan view of the casket cover, on a smaller scale, having marks thereon indicated by phantom lines, suggesting where the cover may be cut off for various lengths.
FIG. 8 is a perspective view of the end plate for the casket of FIG. 6.

Briefly stated, the invention is an animal pet casket which is composed of modular units which are held in place by means of a locking cover and which can be adjusted longitudinally so as to accommodate deceased animal pets of small, medium or large size.

Referring to FIG. 1 and FIG. 2, the modular casket may be composed of resin, thermoplastic or thermosetting, foamed or porous, with or without reinforcement such as glass fiber or fabric. In FIG. 1 and FIG. 3, there is shown a composite casket which includes three modular units *a*, *b* and *c*. These units are constructed so that unit *b* is minutely wider than units *a* and *c*. This permits *a* and *c* units to slide within the walls of *b* unit. The cover 11 includes locking means having u-shaped edges 14 which are applied by snapping them over reverse *u*-shaped edges 12 of the composite modular casket. The cover, if added strength is desired, could have a slightly thicker gauge than the rest of the casket. This cover serves two purposes. It not only locks the modular units in place but also serves as a carrying means. To further assure locking means at the bottom of the casket to avoid bowing outwardly, a tongue 16 and a groove **16*a* is provided along the inside bottom peripheral edges of each of the modular units. At this point, as shown in FIG. 4 and FIG. 5, the tongue and groove locking means 16 are located as near the bottom as possible to prevent the tendency of the side walls 15** from bowing outwardly because of the weight of the deceased animal pet. Care, however, should be taken that such location should not adversely affect or interfere with proper nesting.

To accommodate a small deceased animal pet, only modular unit *b* is needed. Plates 20 are slid into tracks 22, a cover 11 is cut to size and applied as shown in FIG. 6 and FIG. 2.

To accommodate a medium sized deceased pet, modular units *a* and *b* are tongue and groove united. In unit, *b*, plate 20 is slid into tracks 22 and a cover is cut to size and attached.

To accommodate a large sized deceased pet, as shown in FIG. 1, modular units *a* and *c* are united by tongue and groove to modular unit *b*. Again, the cover is cut to size and then attached.

The cover is molded in a standardized length as shown in FIG. 7 and has applied thereto phantom markings 24 which identify areas to be cut. A roughened area 26 is provided for use of the pet owner to identify name, date and any other pertinent information. The cover could be extrusion molded in 10 or 12 foot lengths. Since it contains location phantom markings, it can be cut to the desired size.

In some instances, it is necessary to provide hermetic sealing. This can be accomplished by applying beaded or spray resin to all areas that have to be sealed.

To provide an economical casket, modular units *a* and *c* are identical. The track and plate as well as the cover are simply designed to keep costs down and still provide an identifiable pet casket.

Although the modular casket has been described for burial use, it could also be used for transport because of its light weight and sealability.

At this point, it is noted that the resin used could be transparent, transluscent, or opaque in any part of the casket. Such opaque resin could in whole or part be replaced by lightweight, pliable metal such as sheet aluminum.

It is further contemplated that these modular caskets could be used to transport deceased persons over long distances because of their light weight and sealability.

While I have illustrated and described an embodiment of my invention, it will be understood that this is by way of illustration only, and that various changes and modifications may be made within the contemplation of our invention and within the scope of the following claims.

We claim:

1. A resinous casket for a large pet comprising interfitting u-shaped longitudinal extending modular units that are fixedly united by a cover locking means wherein a pair of complementary end units open at one end, are connected by sliding said open ends into a central u-shaped unit that is slightly larger than said end units, and having bottom locking means provided with elongated tongue means located near the bottom edge of said two end units with correspondingly shaped grooves on said central unit.

2. The combination of claim 1, wherein the cover locking means includes u-shaped snap-on edges which engage slightly smaller reverse u-shaped edges of said units.

3. The combination of claim 1, wherein such u-shaped engaging edges serve as a lifting means.

4. The combination of claim 1, wherein the sides are tapered for telescoping and are provided for said units for easy storage by nesting.

5. The combination of claim 1, wherein the cover member is formed with phantom markings indicating different sizes for more accurate cutting.

6. The combination of claim 1, wherein a roughened area is provided for indicia marking purposes.

7. The combination of claim 1, wherein bead or sprayed resin is applied to hermetically seal the modular casket for transport or burial.

8. The combination of claim 1, wherein the resinous casket modular units are transparent, transluscent or opaque.

9. The combination of claim 8, wherein at least one of the components of the casket is made of lightweight pliable metal.

10. A resinous casket for a small pet comprising a single u-shaped modular unit having two open ends which are provided with inner side track means wherein each of two panels are inserted to close said open ends and cover locking and carrying means provided with u-shaped snap-on edges that interfit with reverse u-shaped edges at the top of said unit.

11. A resinous casket for a medium sized pet comprising two modular u-shaped units and a closing plate, one modular unit being an end unit with one closed end and the other having two open ends and track means for insertion of said closing plate, a top cover locking means wherein u-shaped edges are fitted over reverse u-shaped edges at the top of the u-shaped units and having bottom locking means wherein inner elongated tongue means at the bottom on said end unit fits into a correspondingly shaped elongated groove at the bottom of said two open ended unit.

* * * * *